United States Patent [19]

Glaser et al.

[11] Patent Number: 4,701,834

[45] Date of Patent: Oct. 20, 1987

[54] HEADLIGHT FOR DIM HEAD LAMPS OF MOTOR VEHICLES

[75] Inventors: Gerhard Glaser, Stuttgart; Gerhard Lindae, Leonberg; Peter Perthus, Stuttgart; Heinz Rein, Reutlingen, all of Fed. Rep. of Germany

[73] Assignee: Robert Bosch GmbH, Stuttgart, Fed. Rep. of Germany

[21] Appl. No.: 893,565

[22] Filed: Aug. 5, 1986

[30] Foreign Application Priority Data

Aug. 31, 1985 [DE] Fed. Rep. of Germany ..... 3531221

[51] Int. Cl.[4] ..... F21M 3/30

[52] U.S. Cl. ..... 362/307; 362/309

[58] Field of Search ..... 362/309, 307, 297, 61, 362/80, 310, 311, 350, 347, 348; 313/113

[56] References Cited

U.S. PATENT DOCUMENTS

| | | | |
|---|---|---|---|
| 4,238,817 | 12/1980 | Fratty | 362/61 |
| 4,303,965 | 12/1981 | Vile et al. | 362/61 |
| 4,530,042 | 7/1985 | Cible et al. | 362/309 |
| 4,607,318 | 8/1986 | Lindae et al. | 362/309 |

*Primary Examiner*—James C. Yeung

*Attorney, Agent, or Firm*—Michael J. Striker

[57] ABSTRACT

A headlight for dim head lamps of motor vehicles includes a paraboloid reflector which has a glowing spiral, and a transparent pane on the inner surface of which seven fields with differently acting optical means are provided. These fields reflect light rays emitted by the glowing spiral and reflected by predetermined zones of the reflector and form a dimming light.

21 Claims, 1 Drawing Figure

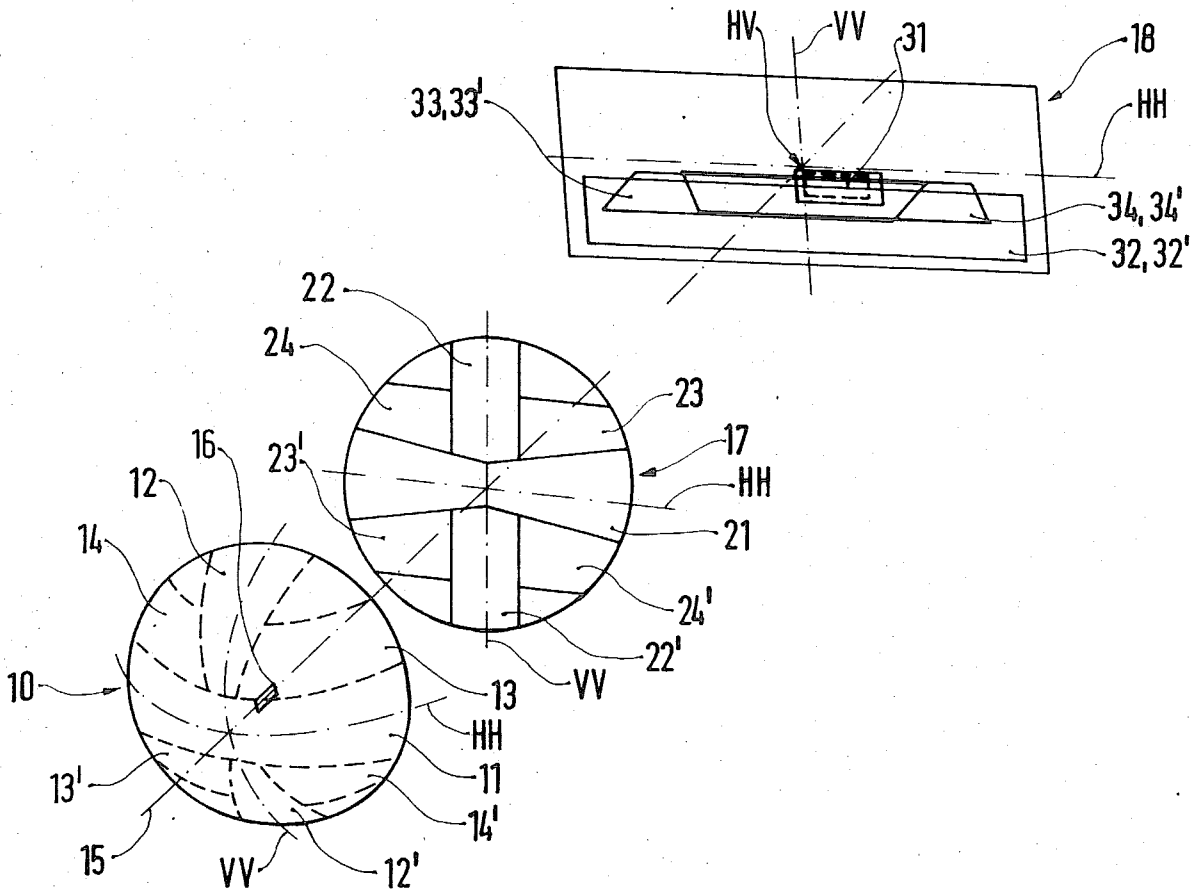
18
HH
34,34'
32,32'
31
VV
HV
33,33'
23
17
HH
21
24'
22'
VV
22
24
23'
13
HH
11
14'
12'
VV
16
12
14
10
13'
15

HEADLIGHT FOR DIM HEAD LAMPS OF MOTOR VEHICLES

BACKGROUND OF THE INVENTION

The present invention relates to a headlight for motor vehicles of the type that includes a paraboloid reflector and a glowing spiral.

Conventional headlights of the foregoing type have the axis of the glowing spiral parallel to the axis of the reflector. Such headlights utilized in the USA must produce a dimming light according to a given light distribution. This light distribution has, in contrast to European dim head lamps, no twilight limitations by means of which the long-range and dazzle-free dimming light is adjustable.

SUMMARY OF THE INVENTION

It is an object of the present invention to provide an improved headlight for motor vehicles.

It is a further object of the invention to provide a headlight for dim head lamps, in which a predetermined twilight limitation of the dimming light would be obtained and thus the adjustment of the headlight would be improved and the driveway would be sufficiently illuminated without dazzling oncoming vehicles.

The invention is based on the assumption that the hot spot of the light can be improved by light density and sharper limitation.

These and other objects of the invention are attained by a headlight for dim head lamps of motor vehicles, comprising a paraboloid reflector; a glowing spiral having a cylinder axis parallel to an axis of said reflector and a hot spot in the vicinity of a focus of said reflector, whereby said reflector forms light rays of said glowing spiral into a rough light beam; a transparent pane; and an optical means which form from said rough light beam a dimming light beam, said transparent pane having a horizontal middle plane and a vertical middle plane, said optical means including vertically upwardly and horizontally rightwardly deviating prisms which are arranged in one field of said transparent pane, said field being positioned on said pane substantially symmetrical to said horizontal middle plane and said vertical middle plane, said field having the height which increases from the axis of said reflector towards the edge of said transparent pane.

The angle of the horizontally rightwardly deviating prism initially increases with an increased distance from the axis of said reflector and then reduces towards the edge of said transparent pane, and the angle of the vertically upwardly deviating prism increases with an increased distance from the axis of said reflector to the edge of said transparent pane.

Two further fields may be arranged on said pane approximately symmetrically with one another relative to said vertical middle plane, said further fields having strong horizontal scattering means which are combined with a vertically downwardly deviating prism. Thereby four partial light beams are scattered in the horizontal direction, and the edges of the driveway are strongly illuminated.

The strong horizontal scattering means may be cylinder lenses.

The inner side of the transparent pane may have additionally a field positioned above said one field and at the right-hand side from said field, a field positioned below said one field and at the left-hand side from the above field, a field positioned above said one field and at the left-hand side from said further field, and a field positioned below said one field and at the right hand side from the further field, whereby said fields have horizontal scattering means which are combined with vertically downwardly deviating prisms, the angle of which decreases with an increased distance from the further fields towards the edges of the transparent pane. Due to this embodiment illumination is improved specifically in the horizontal region.

In the headlight in which the reflector and said transparent pane have a large horizontal extension, the reduction of a prism angle of the vertically downwardly deviating prisms tends towards zero.

The downwardly deviating prisms from the zero point may reverse into upwardly deviating prisms.

The increase in the height of said one field may be continuous, discontinuous or stepwise.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE of the drawing illustrates a stereoscopic simplified view of the reflector with a preset transparent pane of the dimming light-headlight and a measure screen with beams forming a dimming light.

DETAILED DESCRIPTION OF THE PREFERRED EMBODIMENTS

A headlight authorized for use in the USA, the light distribution of which must meet the government regulations, has a paraboloid reflector 10 having an axis 15, and a glowing spiral 16, the cylindrical axis of which is parallel to the axis 15 and the center of gravity of which is located in the vicinity of the reflector focus.

Reflector 10 reflects light beams emitted by the glowing spiral 16 and forms a so-called rough light beam. The reflection surface of the reflector is, outside the paraboloid zones, subdivided substantially into zones 11, 12, 12′, 13, 13′ and 14, 14′.

A transparent pane 17 is arranged before reflector 10. At the inner surface of this pane, facing the reflector 10, optical means are provided, which are combined in accordance with different effects into fields 21, 22, 22′, 23, 23′ and 24, 24′. In regard to a horizontal middle plane HH and a vertical middle plane VV which intersect in the axis 15, the individual fields and the optical means are arranged as follows:

Field 21 is substantially symmetrical to HH and VV, whereby the height of this field increases from the axis 15 towards the edge of the pane 17 so that borders of the field 21 are straight lines. Field 21 has prisms as an optical means, which prisms deviate coming beams of the rough light beams to the vertical upwardly and also to the horizontal and to the right. The angle of the horizontally deviating prism increases at the start with the increase of the distance from the axis 15 of the reflector and decreases then toward the edge of the pane 17; the angle of the vertically deviating prism increases with the increase of the distance from axis 15 of the reflector 10 to the edge of the pane 17.

Field 21 influences a corresponding rough light portion which forms the zone 11 of the reflector 10; the respective dimming light-portion generates from the measuring screen 18 a partial light beam 31 which forms a hot spot of the dimming light beam.

The upper and lower limits or borders of the field 21 and consequently the borders of zone 11 can, instead of being straight line, be curved or stepped or have various configurations. The increase in the height of the field 21 takes place continually or discontinually or in steps.

Two fields 22, 22' of the transparent pane 17 are substantially symmetrical relative to the plan VV and are arranged above and below, respectively of the field 21. These fields 22, 22' have strong horizontal scattering cylinder lenses which are combined with the downwardly vertically deviating prism. The portion of the rough light beam which is generated by zones 12, 12' of the reflector 10 falls onto both fields; this portion forms a partial light beam 32, 32' on the measure screen 18.

The transparent pane 17 has also four other fields, namely field 23 positioned above field 21 and at the right-hand side from field 22, field 23' positioned below field 21 and at the left-hand side from field 22', field 24 located above field 21 and at the left-hand side from field 22, and field 24' positioned below field 21 and at the right-hand side from field 22'. The portions of the rough light beam falling onto these fields derive from zones 13, 13' and 14, 14' of the reflector whereby these portions form through the transparent pane 17 in the partial light beams 33, 33' and 34, 34' a dimming light beam on the measure screen.

In the headlights of dim head lamps the reflector and transparent pane of which have a large horizontal extension, the angle of the vertically downwardly deviating prisms of fields 23, 23' and 24, 24' tends to decrease towards zero. This tendency can cause that the downwardly deviating prisms at the off-zero point would reverse into the upwardly deviating prism.

The axis 15 of the reflector 10 is pivoted relative to the HV-point, which is the point of intersection of lines HH and VV, towards the measure screen 18 by two degrees vertically downwardly and by two degrees horizontally to the right, which is not shown in the drawing.

It will be understood that each of the elements described above, or two or more together, may also find a useful application in other types of headlight for motor vehicles differing from the types described above.

While the invention has been illustrated and described as embodied in a headlight for motor vehicles, it is not intended to be limited to the details shown, since various modifications and structural changes may be made without departing in any way from the spirit of the present invention.

Without further analysis, the foregoing will so full reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A headlight for dim head lamps of motor vehicles, comprising a paraboloid reflector; a glowing spiral having a cylinder axis parallel to an axis of said reflector and a hot spot in the vicinity of a focus of said reflector whereby said reflector forms light rays of said glowing spiral into a rough light beam; a transparent pane; and optical means which form from said rough light beam a dimming light beam, said transparent pane having a horizontal middle plane HH and a vertical middle plane VV, said optical means including vertically upwardly and horizontally rightwardly-deviating prisms which form only one portion (21) of said optical means on said transparent pane, said portion being positioned on said pane substantially symmetrical to said horizontal middle plan HH and said vertical middle plane VV, said portion having the height which increases from the axis of said reflector towards the edge of said transparent pane whereby said portion improves a hot spot of light intensity of the headlight.

2. The headlight as defined in claim 1, wherein the angle of the horizontal rightwardly deviating prism initially increases with an increased distance from the axis (15) of said reflector and then reduces towards the edge of said transparent pane, and the angle of the vertically upwardly deviating prism increases with an increased distance from the axis of said reflector to the edge of said transparent pane.

3. The headlight as defined in claim 1, wherein said optical means include two further portions (22, 22') arranged on said pane approximately symmetrically with one another relative to said vertical middle plane, said further portions having strong horizontal scattering means which are combined with a vertically downwardly deviating prism.

4. The headlight as defined in claim 3, wherein said strong horizontal scattering means are cylinder lenses.

5. The headlight as defined in claim 4, wherein said optical means further include a portion (23) at an inner side of the transparent pane and positioned above the portion (21) and at the right-hand side from the portion (22), a portion (23') positioned below the portion (21) and at the left-hand side from the portion (22'), a portion (24) positioned above the portion (21) and at the left-hand side from the portion (22), and a portion (24') positioned below the portion (21) and at the right-hand side from the portion (22'), whereby said portions have horizontal scattering means which are combined with vertically downwardly deviating prisms, the angle of which decreases with an increased distance from the portions (22, 22') towards the edge of the transparent pane.

6. The headlight as defined in claim 5, wherein said horizontal scattering means are cylinder lenses.

7. The headlight as defined in claim 5, wherein said reflector and said transparent pane have a large horizontal extension, and wherein the reduction of a prism angle of the vertically downwardly deviating prisms tends towards zero.

8. The headlight as defined in claim 7, wherein the downwardly deviating prisms from zero reverse into upwardly deviating prisms.

9. The headlight as defined in claim 1, wherein the increase in the height of the portion (21) is continuous.

10. The headlight as defined in claim 1, wherein the increase in the height of the portion (21) is discontinuous.

11. The headlight as defined in claim 1, wherein the increase in the height of the portion (21) is step-like.

12. A headlight for dim head lamps of motor vehicles, comprising a paraboloid reflector; a glowing spiral having a cylinder axis parallel to an axis of said reflector and a hot spot in the vicinity of a focus of said reflector whereby said reflector forms light rays of said glowing spiral into a rough light beam; a transparent pane; and optical means which form from said rough light beam a dimming light beam, said transparent pane having a horizontal middle plane HH and a vertical middle plane VV, said optical means including vertically upwardly and horizontally rightwardly-deviating prisms which form one portion (21) of said optical means on said transparent pane, said portion being positioned on said pane substantially symmetrical to said horizontal middle plane and said vertical middle plane, said portion having the height which increases from the axis of said reflector towards the edge of said transparent pane, wherein the angle of the horizontal rightwardly deviating prism initially increases with an increased distance from the axis (15) of said reflector and then reduces towards the edge of said transparent pane, and the angle of the vertically upwardly deviating prism increases with an increased distance from the axis of said reflector to the edge of said transparent pane.

13. A headlight for dim head lamps of motor vehicles, comprising a paraboloid reflector; a glowing spiral having a cylinder axis parallel to an axis of said reflector and a hot spot in the vicinity of a focus of said reflector whereby said reflector forms light rays of said glowing spiral into a rough light beam; a transparent pane; and optical means which form from said rough light beam a dimming light beam, said transparent pane having a horizontal middle plane HH and a vertical middle plane VV, said optical means including vertically upwardly and horizontally rightwardly-deviating prisms which form one portion (21) of said optical means on said transparent pane, said portion being positioned on said pane substantially symetrical to said horizontal middle plane and said vertical middle plane, said portion having the height which increases from the axis of said reflector towards the edge of said transparent pane, said optical means further including two further portions (22, 22') arranged on said pane approximately symmetrically with one another relative to said vertical middle plane, said further portion having strong horizontal scattering means which are combined with a vertically downwardly deviating prism.

14. The headlight as defined in claim 13, wherein said strong horizontal scattering means are cylinder lenses.

15. The headlight as defined in claim 14, wherein said optical means further include a portion (23) at an inner side of the transparent pane and positioned above the portion (21) and at the right-hand side from the portion (22), a portion (23') positioned below the portion (21) and at the left-hand side from the portion (22'), whereby said portions have horizontal scattering means which are combined with vertically downwardly deviating prisms, the angle of which decreases with an increased distance from the portions (22, 22') towards the edge of the transparent pane.

16. The headlight as defined in claim 15, wherein said horizontal scattering means are cylinder lenses.

17. The headlight as defined in claim 15, wherein said reflector and said transparent pane have a large horizontal extension, and wherein the reduction of a prism angle of the vertically downwardly deviating prisms tends towards zero.

18. The headlight as defiend in claim 17, wherein the downwardly deviating prisms from zero reverse into upwardly deviating prisms.

19. The headlight as defined in claim 13, wherein the increase in the height of said one portion (21) is continuous.

20. The headlight as defined in claim 13, wherein the increase in the height of said one portion (21) is discontinuous.

21. The headlight as defined in claim 13, wherein the increase in the height of said one portion (21) is steplike.

* * * * *